US007959315B2

(12) United States Patent
Yan

(10) Patent No.: US 7,959,315 B2
(45) Date of Patent: Jun. 14, 2011

(54) INTERCHANGEABLE ILLUMINATED ORNAMENT

(76) Inventor: Suen Ching Yan, Carson, CA (US)

( * ) Notice: Subject to any disclaimer, the term of this patent is extended or adjusted under 35 U.S.C. 154(b) by 223 days.

(21) Appl. No.: 12/221,764

(22) Filed: Aug. 6, 2008

(65) Prior Publication Data

US 2010/0033958 A1 Feb. 11, 2010

(51) Int. Cl.
*F21V 21/08* (2006.01)

(52) U.S. Cl. ..... 362/106; 362/156

(58) Field of Classification Search ..... 362/103, 362/104, 105, 106, 800, 156, 108, 570, 571; 2/906, 209.13, 102, 239; 150/106, 100
See application file for complete search history.

(56) References Cited

U.S. PATENT DOCUMENTS

| | | | | |
|---|---|---|---|---|
| 2,640,980 | A | 6/1953 | Prupis | |
| 2,649,980 | A | 6/1953 | Prupis | |
| 2,788,439 | A | 4/1957 | Hesse | |
| 3,032,647 | A | 5/1962 | Wansky et al. | |
| 3,358,137 | A | 12/1967 | Fraser | |
| 3,749,902 | A | 7/1973 | Drew | |
| 4,090,232 | A | 5/1978 | Golden | |
| 4,186,429 | A | 1/1980 | Johnston | |
| 4,781,036 | A | 11/1988 | Erickson | |
| 4,959,890 | A | 10/1990 | Pazurek | |
| 4,991,068 | A | 2/1991 | Mickey | |
| D318,338 | S | 7/1991 | Mitchell | |
| 5,239,450 | A | 8/1993 | Wall | |
| 5,404,593 | A | 4/1995 | Kronenberger | |
| 5,510,961 | A | 4/1996 | Peng | |
| 5,541,816 | A | 7/1996 | Miserendino | |
| 5,680,718 | A | 10/1997 | Ratcliffe et al. | |
| 5,741,060 | A | 4/1998 | Johnson | |
| 5,845,987 | A | 12/1998 | Painter | |
| D407,187 | S | 3/1999 | Makki | |
| 6,012,203 | A | 1/2000 | Baron Pearson | |
| 6,032,293 | A | 3/2000 | Makki | |
| 6,056,413 | A | 5/2000 | Urso | |
| 6,168,286 | B1 * | 1/2001 | Duffy | 362/106 |
| 6,244,721 | B1 | 6/2001 | Rodgriguez et al. | |
| 6,328,454 | B1 | 12/2001 | Davis | |
| 6,461,015 | B1 | 10/2002 | Welch | |
| 6,588,067 | B2 | 7/2003 | Efron et al. | |
| 6,594,871 | B2 | 7/2003 | Hoffman | |
| 2002/0118533 | A1 | 8/2002 | Marston | |
| 2002/0159249 | A1 | 10/2002 | Mickey | |
| 2004/0117894 | A1 * | 6/2004 | Kuo | 2/209.13 |
| 2005/0066422 | A1 * | 3/2005 | Yan | 2/209.13 |
| 2005/0207143 | A1 | 9/2005 | Bishop et al. | |
| 2006/0032270 | A1 | 2/2006 | Doyno | |
| 2006/0212994 | A1 | 9/2006 | Proctor | |

FOREIGN PATENT DOCUMENTS

| | | |
|---|---|---|
| EP | 1072204 | 1/2001 |

* cited by examiner

*Primary Examiner* — Bao Q Truong
(74) *Attorney, Agent, or Firm* — Cislo & Thomas, LLP

(57) ABSTRACT

A simple, low-cost wearable ornament system is disclosed that allows the user to easily interchange ornaments and may be used on wearable items such as garments, footwear, belts, hats, helmets, purses, backpacks, tote bags, scarves and other items. The system generally comprises a reinforced opening, grommet or eyelet in the garment, headwear or other item, an extended base, a screw cap, bottom housing and a decorative item or ornament member. A user desiring to change the design on the ornament system can easily interchange an existing ornament member with a new ornament member without damaging the wearable item and, if desired, without having to remove the garment or other wearable item.

20 Claims, 5 Drawing Sheets

INTERCHANGEABLE ILLUMINATED ORNAMENT

BACKGROUND OF THE INVENTION

1. Field of the Invention

This invention relates generally to wearable ornaments, and more particularly to a system for interchangeable ornaments, including lighted ornaments, that may be used to decorate clothing, hats, backpacks, purses and other items.

2. Description of the Related Art

Existing wearable ornament devices and wearable illuminated ornament systems have limitations, including, complexity, the manner of attachment and appearance. In addition, existing wearable ornament systems are generally fabricated for use with a single ornament or decorative design. If the wearer wishes to change the ornament or design, the ornament or design portion may not be removable or removal of the ornament may require disassembling the device and, if lighted, also the batteries powering the device.

In addition, some existing ornamental devices attach to the garment, hat or other item with pins or pin-like devices that damage the garment or other item, particularly if continually removed and re-attached. In addition, devices that are difficult to manipulate, require disassembly or contain pin-like attachment mechanisms may not be suitable for use with children's clothing and accessories. Therefore, a safe, a low-cost, simple and easily manipulated system for displaying wearable ornaments that can be easily interchanged is desirable.

SUMMARY OF THE INVENTION

The present invention includes a low-cost wearable ornament system that allows the user to easily interchange ornaments and may be used on wearable items such as garments, footwear, belts, hats, helmets, purses, backpacks, tote bags, scarves and other items and can be continually interchanged without damaging the item. The system generally comprises a reinforced opening, grommet or eyelet in the garment, headwear or other item, an extended base, a screw cap, bottom housing and a decorative item or ornament member. The bottom housing is configured so that it sits through the reinforced opening and is configured to interface with the screw cap. For example, the screw cap may comprise screw threads that interface with complementary threads or flange on the bottom housing to engage the screw cap and the bottom housing. To interchange the decorative portion of the system or the ornament member, the user disengages the screw cap and bottom housing, replaces the existing ornament member with a new ornament member and engages the screw cap with the bottom housing.

The interchangeable ornaments described herein may be used, and the ornament changed, without complicated manipulation and without pin-like attachment mechanisms.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention as set forth in the independent claims.

Figure 1:
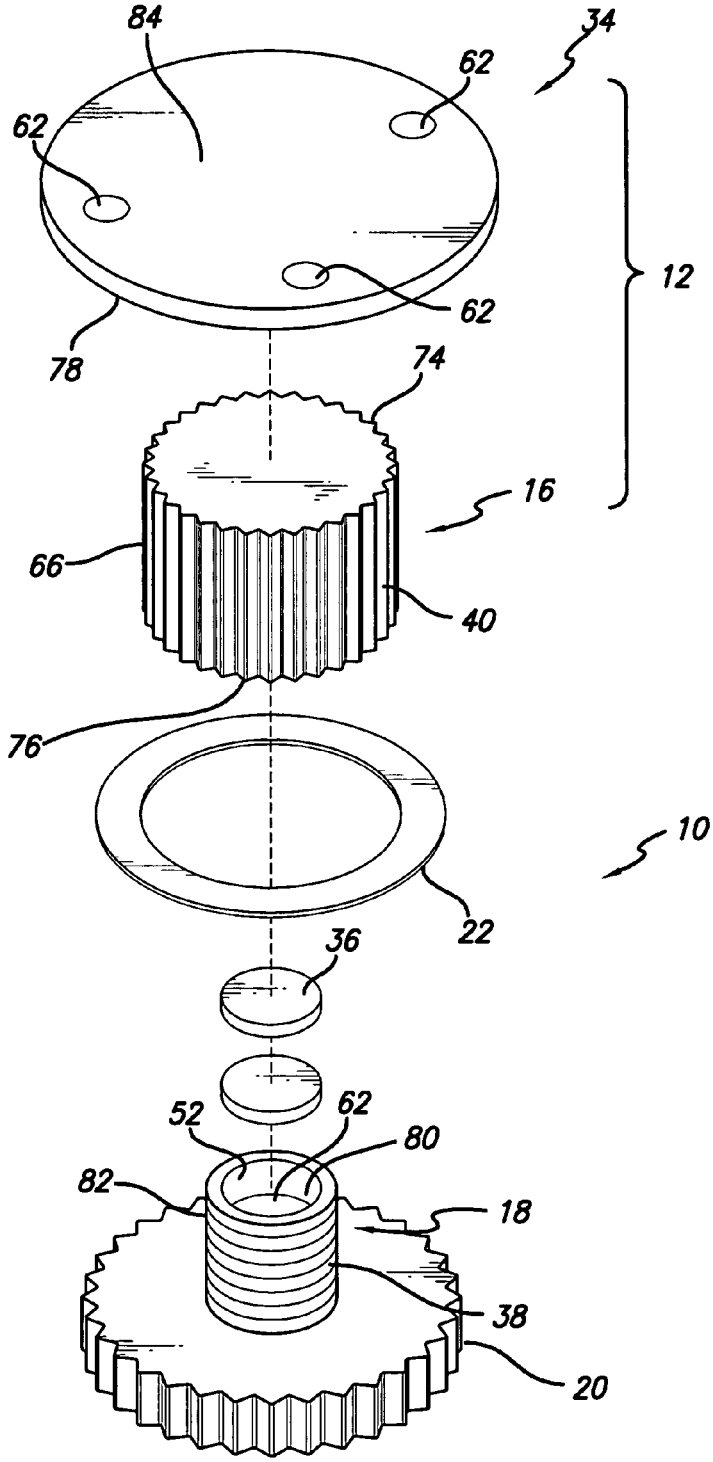
FIG. 1 is an exploded view of a interchangeable ornament system according to one embodiment of the present invention.

An interchangeable illuminated ornament according to the one embodiment of the present invention is shown in FIG. 1, generally at 10. In the preferred embodiment, the interchangeable illuminated ornament 10 typically includes an ornament member 12 comprising an ornamental face 14, a screw cap 16, and a bottom housing 18, and an extended base 20, and an eyelet 22. In embodiments, the interchangeable illuminated ornament 10 may be used to decorate wearable items such as a purse 24, backpack 26 or other item such as headwear 28.

For example, in one embodiment, the interchangeable illuminated ornament may be used to decorate headwear 28, which comprises a crown 30 and bill 32. Headwear 28 may be a typical baseball style cap, as shown in the figures, however, it would be appreciated that headwear 28 could be many other types of headwear including sunhats, berets, ski hats and the like. An ornament member 12, including an ornamental face 14, such as an illuminated ornament face 34, may be used to decorate the headwear 28 at the crown 30, for example where the button of the baseball style cap would be. However, it will be appreciated that interchangeable ornament 10 may be displayed on the headwear item 28, or other items, in many locations such as on the bill 32 of a hat or at the back of the headwear or on the front of a purse 24 or backpack 26.

FIG. 1 shows an interchangeable illuminated ornament comprising an illuminated ornament face 34 according to one embodiment of the present invention. The ornament face 34 preferably comprises a design 84 and may include a translucent portion (not shown), which allows illumination from at least one illuminating element 62 disposed on or within the illuminated ornament face 34 to pass therethrough. The ornament member 12 in the illuminated and non-illuminated embodiments preferably includes a screw cap 16 that is configured to couple to the bottom housing 18, which in turn is configured to couple to the extended base 20. The screw cap preferably includes a screw cap outer surface 66, a screw cap inner surface 68 and screw cap walls 70 defining a screw cap recess 72. The screw cap 16 may also comprise a screw cap upper end 74 and a screw cap bottom end 76. The screw cap 16 is preferably attached to a back face 78 of the ornament face 14 at one of the screw cap ends, such as for example the screw cap upper end 74. The screw cap 16 may be formed integral with the ornament face 14 or it may be attached to the ornament face 14 by suitable attachment methods known in the art, such as gluing, welding or screw threads.

The bottom housing 18 preferably comprises a bottom housing inner surface 80, and a bottom housing outer surface 82 and bottom housing sidewalls 52 defining a bottom recess 52. The extended base 20 may be formed integral with the bottom housing 18 or may couple by suitable means known in the art to the bottom housing 18. For example, the bottom housing 18 may comprise flanges or threads that permit the bottom housing 18 to couple or screw into or onto the extended base 20, or the bottom housing 18 may be glued or welded onto the extended base 20. In the preferred embodiment, the bottom housing 18 interfaces with the extended base 20 so that it is preferably substantially centered on the extended base 20.

The screw cap 16 also preferably includes a top coupling portion 40 that is configured to couple to a bottom coupling portion 38 on or in the bottom housing 18. For example, in one embodiment, the screw cap 14 may comprise screw threads or flanges that interface with flanges or screw threads on or in the bottom housing 18. It will be appreciated that even though top coupling portion 40 and bottom coupling portion 38 are shown as thread and screw type elements, many other coupling configurations may be used, as desired.

The bottom housing 18 and bottom recess 52 may be configured to receive power elements 36 to power the illuminated ornament face 34 (FIG. 1). Power elements 36 are typically batteries, but may be other types of devices that can deliver power to the illuminated ornament face 34. It will be appreciated that although two power elements 36 are shown, any number of power elements may be used to power the illuminated ornament face, as desired. An aperture 58 may be disposed in the extended base 20 for removing power elements 36 within bottom housing 18 by pressing or poking through the aperture 58 to dislodge power elements 36.

Figure 2A:
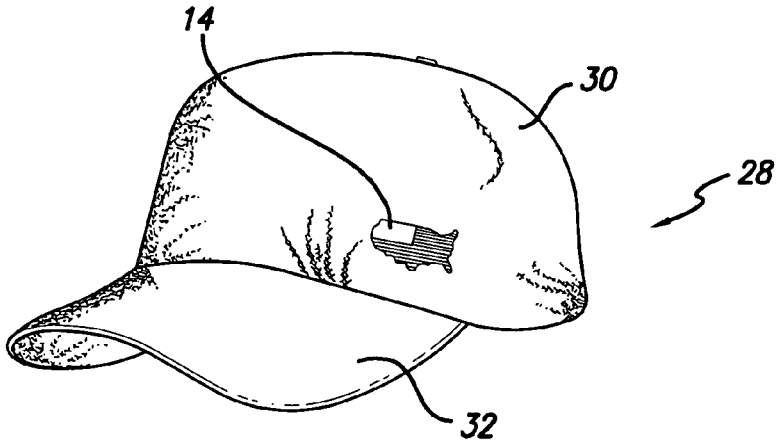
FIG. 2*a* is a perspective view of a interchangeable ornament system according to one embodiment of the present invention.
Figure 2B:
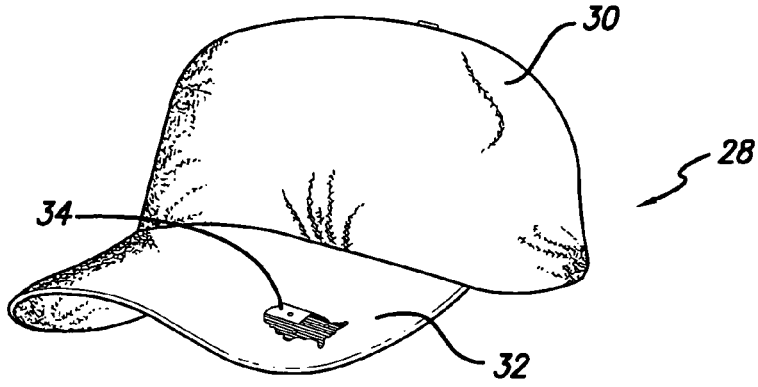
FIG. 2*b* is a plan view of an illuminating device including a bottom housing and base according to an embodiment of the present invention
Figure 2C:
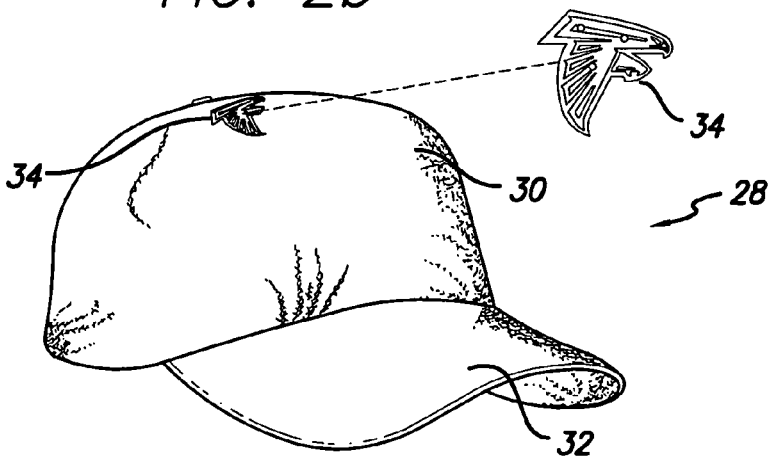
FIG. 2*c* is a perspective view of a interchangeable ornament system according to one embodiment of the present invention.

FIG. 2 shows the illuminated ornament face 34 along with examples showing portions of headwear 28 where the ornament member 12 may be displayed.

In the preferred embodiments, the extended base 20 is preferably placed on the underside or inside of headwear 28, purse 24, backpack 26, or other item, such that the bottom housing 18 extends through an eyelet 22 disposed in the fabric or material of the headwear 28, purse 24, backpack 26, or other item and the extended base 20 sits against or adjacent the eyelet 22. The screw cap 16 may then be interfaced with the bottom housing so that the eyelet 22 is disposed between the ornament face 14 and the extended base 20 and so that the eyelet 22 preferably rings the bottom housing 18. The system may also be configured so that the eyelet 22 is disposed between the bottom end 76 of the screw cap 16 and the extended base 20. The screw cap 16 may then be turned in relation to the bottom housing 18, or vice versa, to tighten engagement of the screw cap and bottom housing 18 and to secure placement of the ornament member 12 on the headwear 28, purse 24, backpack 26 or other item.

In the preferred embodiment a dimension or a diameter of the extended base 20 is preferably larger than a dimension or a diameter of the eyelet 22. For example, the eyelet diameter and extended base diameter may have the dimensions shown in Row D1 in Table 1, more preferably the dimensions shown in Row D2 and most preferably the dimensions shown in Row D3, although other suitable dimensions may be used.

TABLE 1

| Row | Eyelet diameter | Extended base diameter |
|---|---|---|
| D1 | Approx 1 mm-approx 75 mm | Approx 5 mm-approx 80 mm |
| D2 | Approx 10 mm-approx 65 mm | Approx 15 mm-approx 70 mm |
| D3 | Approx 20 mm-approx 45 mm | Approx 25 mm-approx 50 mm |

In the preferred embodiment, at least a portion of the screw cap 16, when the screw cap 16 is engaged with the bottom housing 18, sits concentrically about the bottom housing 18. Alternately, in embodiments, the interchangeable illuminated ornament 10 may be configured so that at least a portion of the bottom housing 18 sits concentrically about at least a portion of the screw cap 16. The screw cap 16 and bottom housing 16 are preferably configured so that, when engaged, a dimension or a diameter of the engaged screw cap 16 and bottom housing 18 total less than the dimension or the diameter of the eyelet 22. In an alternate embodiment, the screw cap 16 may be configured to friction fit into or over bottom housing 18, and the extended base 20 may be used to pull the screw cap 16 from the bottom housing 18 to provide easy removal of the ornament member 12.

Figure 3A:
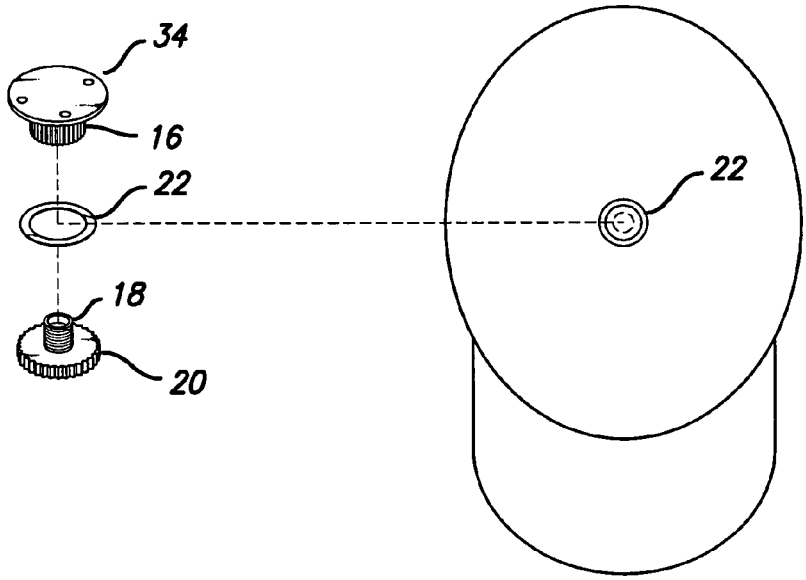
FIG. 3*a* is an exploded view illuminating device showing placement on headwear according to an embodiment of the present invention.
Figure 3B:
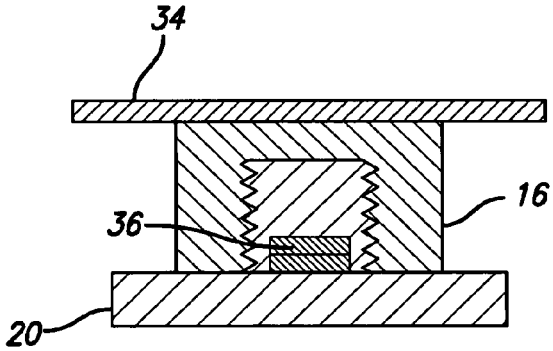
FIG. 3*b* shows the addition of power elements to the embodiment in FIG. 3*a*.
Figure 3C:
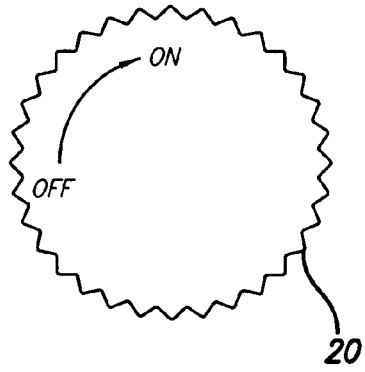
FIG. 3*c* shows the on-off switch according to one embodiment of the present invention.
Figure 4A:
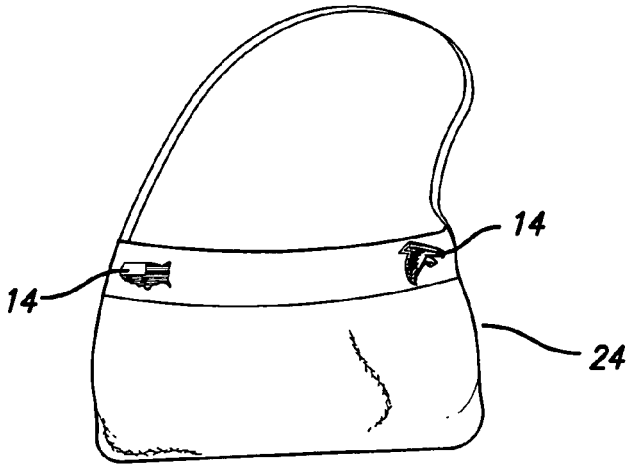
FIG. 4*a* shows the interchangeable ornament attached to a purse according to one embodiment of the present invention.
Figure 4B:
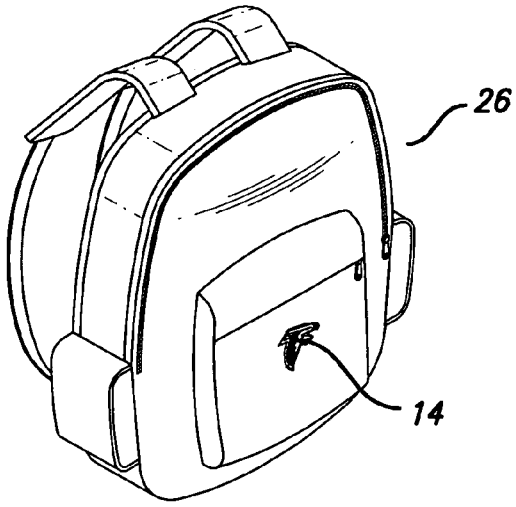
FIG. 4*b* shows the interchangeable ornament attached to a backpack according to one embodiment of the present invention.
Figure 4C:
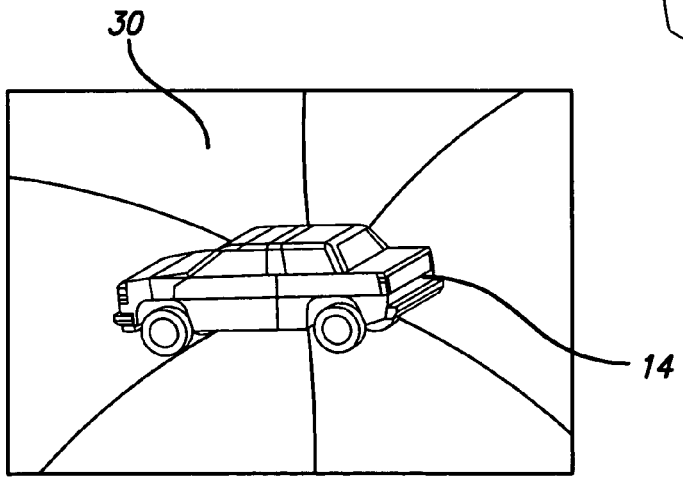
FIG. 4*c* shows the interchangeable ornament attached to the top portion of headwear according to one embodiment of the present invention.
Figure 5:
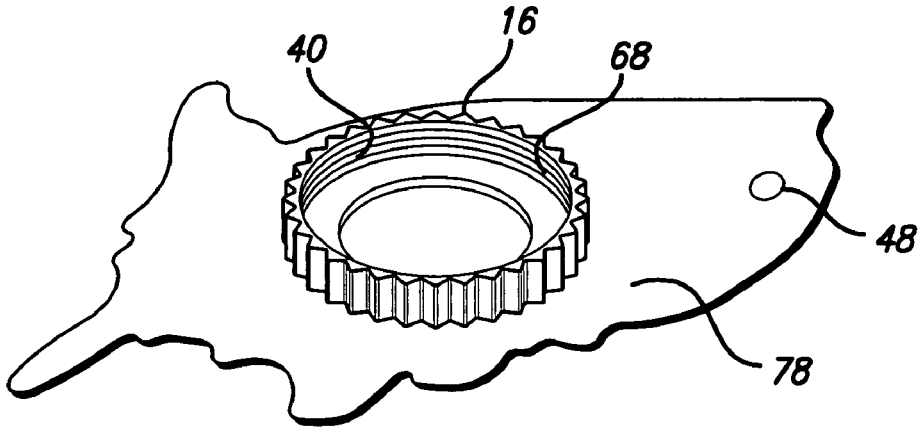
FIG. 5 is a bottom perspective view showing the top coupling portion attached to the back face of the ornament face according to one embodiment of the present invention.

FIG. 3 shows the bottom housing 18, eyelet 22 and extended base 20, along with a portion of the headwear 28, in a coupled position. As shown in FIG. 3, bottom housing 18 in the preferred embodiment preferably extends through an eyelet 22 disposed in headwear 28 and couples by way of the bottom coupling portion 38 to the top coupling portion 40 of the screw cap 16. A user having an ornament member on a wearable item may change the appearance of the ornament member 12 by disengaging the screw cap 16 from the bottom housing 18, replacing the existing ornament member 12 with a different ornament member 12 and engaging the screw cap 16 of the new ornament member 12 with the bottom housing 18. The configuration of the interchangeable illuminated ornament 10 permits a user to change an existing ornament member 12 with an new ornament member 12 without the user having to remove the wearable item; i.e. the ornament member 12 can be replaced while the user is wearing the wearable item.

The illuminated ornament face 34 may include at least one illuminating element 62, and control circuit 64. The illuminating element(s) 62 may comprise an LED(s), or light emitting diode(s), but other illuminating devices may be used. Power elements 36 are preferably configured to power control circuit 64 and illuminating elements 62.

In the preferred embodiment, the screw cap 16 preferably comprises a top coupling portion 40 configured to couple to bottom coupling portion 38 of bottom housing 18. To energize control circuit 64 from power elements 36, the screw cap 16 may be screwed down tighter, and loosened when power is to be disconnected. For example, the interchangeable illuminated ornament 10 may be configured so that the user is able to turn the illuminated ornament face 34 on and off by turning the extended base 20 from a first position to a second position. Other configurations, however, may be used to turn power on and off to control circuit 64 and illuminating element 62, such as for example, an actuator or switch configuration. For example, the control circuit 64 may be activated by pressing down on the ornament member 12 to activate on-off switch 48 or an on-off switch may be located on the underside of the illuminated ornament face 34 to alternately turn on and off power to control circuit 64, however, it will be appreciated that other activation configurations may be utilized, as desired. Illuminating element 62 is typically an LED; however other illuminating elements may be used as desired.

In an alternate embodiment, items comprising relatively hard materials such as helmets or other items made of ABS plastic may comprise a grommet or other reinforced aperture. The extended base 20 may be placed on the underside or inside of the item such that the bottom housing 18 extends through the grommet or reinforced aperture disposed in the item. The screw cap 16 may then be engaged with the bottom housing so that the grommet or reinforced aperture is disposed between ornament face 14 and the extended base 20 and the grommet preferably rings the bottom housing 18. The screw cap 16 may then be turned in relation to the bottom housing 18, or vice versa, to tighten engagement of the screw cap and bottom housing 18 and to secure placement of the ornament member 12 on the item.

While the present invention has been described with regards to particular embodiments, it is recognized that additional variations of the present invention may be devised without departing from the inventive concept.

What is claimed is:

1. An interchangeable illuminated ornament, comprising:

a wearable item comprising an eyelet disposed in the wearable item, the eyelet having an eyelet diameter;

an ornament member, the ornament member comprising a screw cap having a top end and a bottom end and a top coupling portion, the ornament member also comprising an ornament face having a front surface and a back surface, wherein the screw cap is attached at its top end to the back surface of the ornament face;

a bottom housing comprising an outer surface, an inner surface and sidewalls defining a recess, the bottom housing also comprising a bottom coupling portion disposed on the outer surface of the bottom housing; and an extended base having an extended base diameter, the extended base diameter being larger than the eyelet diameter, wherein the bottom housing is seated through the eyelet and the bottom coupling portion engages the top coupling portion so that at least a portion of the screw cap is arranged concentric about at least a portion of the bottom housing and the eyelet is disposed between the ornament face and the extended base and wherein a user may interchange ornaments by disengaging the screw cap from the bottom housing and replacing an existing ornament member with a different ornament member.

2. The system of claim 1, wherein said wearable item is selected from the group consisting of headwear, backpacks, purses, tote bags, garments and scarves.

3. The system of claim 1, wherein the ornament face is an illuminated ornament face.

4. The system of claim 3, further comprising illuminating elements.

5. The system of claim 4, further comprising a control circuit to control operation of the illuminating elements.

6. The system of claim 5, further comprising at least one power element to power the control circuit and illuminating elements.

7. An interchangeable illuminated ornament, comprising:

a wearable item comprising an eyelet disposed in the wearable item, the eyelet having an eyelet diameter;

an ornament member, the ornament member comprising a screw cap having a top end and a bottom end and a top coupling portion, the ornament member also comprising an illuminated ornament face having a front surface and a back surface, wherein the screw cap is attached at its top end to the back a bottom housing comprising an outer surface, an inner surface and sidewalls defining a recess, the bottom housing also comprising a bottom coupling portion disposed on the outer surface of the bottom housing;

at least one illuminating element disposed on the front face of the illuminated ornament face and a control circuit disposed in the illuminated ornament face;

at least one power element disposed in the recess to power the control circuit and the illuminating element;

an extended base having an extended base diameter, the extended base diameter being larger than the eyelet diameter, wherein the bottom housing is seated through the eyelet and the bottom coupling portion engages the top coupling portion so that at least a portion of the screw cap is arranged concentric about at least a portion of the bottom housing and the eyelet is disposed between the ornament face and the extended base and wherein a user may interchange ornaments by disengaging the screw cap from the bottom housing and replacing an existing ornament member with a different ornament member.

8. The system of claim 7, wherein a user can turn the illuminated ornament face on and off by turning the extended base from a first position to a second position.

9. The system of claim 7, wherein the illuminated ornament face comprises an on-off switch on the back surface of the illuminated ornament face for turning the illuminated ornament face on and off.

10. The device of claim 7, wherein the wearable item is selected from the group consisting of headwear, backpacks, purses, tote bags, garments and scarves.

11. An interchangeable illuminated ornament system, comprising a wearable item comprising an eyelet, the eyelet having an eyelet diameter;

an ornament member comprising an illuminated ornament face having a front face and a back face, the ornament member also comprising a screw cap including a top coupling portion;

a bottom housing comprising sidewalls defining a recess, the bottom housing also comprising a bottom coupling portion;

at least one illuminating element disposed on the front face of the illuminated ornament face;

at least one power element disposed in the bottom recess and configured to supply power to said illuminating element; and an extended base having an extended base diameter, the extended base diameter being larger than the eyelet diameter, wherein the bottom housing is seated through the eyelet and the bottom coupling portion engages the top coupling portion so that at least a portion of the screw cap is arranged concentric about at least a portion of the bottom housing and the eyelet is disposed between the illuminated ornament face and the extended base and wherein a user may interchange ornaments by disengaging the screw cap from the bottom housing and replacing an existing ornament member with a different ornament member.

12. The system of claim 11, wherein the wearable item is selected from the group consisting of headwear, backpacks, purses, tote bags, garments and scarves.

13. The system of claim 12, wherein the wearable item is a baseball cap and the eyelet is disposed on the bill of the baseball cap.

14. The system of claim 12, wherein the wearable item is a baseball cap and the eyelet is disposed on the crown of the baseball cap.

15. The system of claim 11, further comprising a control circuit configured to control the operation of the illuminating elements.

16. The system of claim 11, wherein the illuminating element comprises a light emitting diode.

17. The system of claim 11, wherein a user can exchange an existing ornament member with a new ornament member without removing the wearable item.

18. The system of claim 11, wherein the eyelet diameter is from about 1 millimeters to about 75 millimeter and the extended base diameter is from about 5 millimeters to about 80 millimeters.

19. The system of claim 18, wherein the eyelet diameter is from about 10 millimeters to about 65 millimeters and the extended base diameter is from about 15 millimeters to about 70 millimeters.

20. The system of claim 19, wherein the eyelet diameter is from about 20 millimeters to about 45 millimeters and the extended base diameter is from about 25 millimeters to about 50 millimeters.

* * * * *